US005560529A

United States Patent [19]

Udagawa et al.

[11] Patent Number: 5,560,529

[45] **Date of Patent: *Oct. 1, 1996**

[54] CARTRIDGE FOR ELECTRIC STAPLER

[75] Inventors: Hiroshi Udagawa; Toru Yoshie, both of Tokyo, Japan

[73] Assignee: Max Co., Ltd., Tokyo, Japan

[ * ] Notice: The term of this patent shall not extend beyond the expiration date of Pat. No. 5,454,503.

[21] Appl. No.: 285,714

[22] Filed: Aug. 4, 1994

[30] Foreign Application Priority Data

Aug. 4, 1993 [JP] Japan ..... 5-212272

[51] Int. Cl.[6] ..... B25C 5/04; B27F 7/21

[52] U.S. Cl. ..... 227/136; 227/120; 227/131

[58] Field of Search ..... 227/7, 120, 131, 227/132, 135, 136

[56] References Cited

U.S. PATENT DOCUMENTS

| | | | |
|---|---|---|---|
| 3,009,618 | 11/1961 | Lerner | 227/136 X |
| 4,570,841 | 2/1986 | Olesen | 227/95 |
| 4,588,121 | 5/1986 | Olesen | 227/120 |
| 4,623,082 | 11/1986 | Kurosawa | 227/7 |
| 5,269,451 | 12/1993 | Udagawa et al. | 227/120 |
| 5,273,199 | 12/1993 | Logtens | 227/120 |
| 5,346,114 | 9/1994 | Udagawa et al. | 227/120 |
| 5,454,503 | 10/1995 | Udagawa et al. | 227/136 X |

FOREIGN PATENT DOCUMENTS

| | | | |
|---|---|---|---|
| 0446055 | 9/1991 | European Pat. Off. . | |
| 0475436 | 3/1992 | European Pat. Off. . | |
| 1028083 | 4/1958 | Germany . | |
| 454683 | 5/1992 | Japan . | |
| 4-304977 | 10/1992 | Japan | 227/136 |
| 469112 | 5/1993 | Sweden . | |
| 9320977 | 10/1993 | WIPO . | |

*Primary Examiner*—Scott A. Smith
*Assistant Examiner*—Jay A. Stelacone
*Attorney, Agent, or Firm*—Cushman Darby & Cushman, L.L.P.

[57] ABSTRACT

A cartridge for an electric stapler comprises an inner cartridge for holding a plurality of staple sheets in multi-layered form, each of the stapler sheets being formed by sticking straight staples together in sheet-like form, and an outer cartridge associated with the inner cartridge and detachably mounted on the electric stapler. The outer cartridge includes an accommodating section for accommodating the inner cartridge, a staple passage formed so as to extend from a lower end of the accommodating section, a staple receiving stand disposed at a front end of the staple passage, a pusher for pushing legs of a staple forward, the staple being formed into a square U-shape on the staple receiving stand, and a drive channel, arranged at the front of the staple passage, for receiving the formed staple pushed by the pusher. A driver plate of the main body of the stapler drives the formed staple in a direction orthogonal to the staple passage.

6 Claims, 7 Drawing Sheets

CARTRIDGE FOR ELECTRIC STAPLER

BACKGROUND OF THE INVENTION

The invention relates to a cartridge that is detachably attached to an electric stapler.

As shown in, e.g., Japanese Unexamined Utility Model Publication No. Hei. 4-54683, a conventional electric stapler is of such a structure as to releasably attach a cartridge to an electric stapler main body, the cartridge accommodating a plurality of staple sheets in multi-layered form and having a pressing spring for pressing the accommodated staple sheets downward from the top. The main body includes: a mechanism for sequentially feeding the staple sheets within the cartridge attached to the main body from the bottommost one; a forming means for forming a staple in the front end of the fed staple sheet into a square U-shape; and a driving means for driving the formed staple toward a material to be stapled. Therefore, once all the staple sheets within the cartridge have been consumed, the old cartridge is replaced with a new cartridge and then scrapped.

However, the cartridge main body excluding the staple sheets is made of synthetic resin and contains therein the metal spring for pressing the staple sheets. Therefore, the disposal of the cartridge main body as it is imposes a problem in terms of environmental protection.

SUMMARY OF THE INVENTION

The invention has been made in view of the above problem. Accordingly, the object of the invention is to provide a cartridge for an electric stapler, which is formed of a simply designed inner cartridge and an outer cartridge, the inner cartridge being formed by binding a plurality of staple sheets in multi-layered or rolled form and the outer cartridge being releasably attached to an electric stapler main body, and which is capable of saving waste by minimizing scraps while replacing only the inner cartridge.

To achieve the above object, the invention is applied to a cartridge for an electric stapler comprising an inner cartridge for holding a plurality of staple sheets in multi-layered form, each of the stapler sheets being formed by sticking straight staples together in sheet-like form, and an outer cartridge associated with the inner cartridge and detachably mounted on the electric stapler. The outer cartridge includes an accommodating section for accommodating the inner cartridge, a staple passage formed so as to extend from a lower end of the accommodating section, a staple receiving stand disposed at a front end of the staple passage, a pusher for pushing legs of a staple forward, the staple being formed into a square U-shape on the staple receiving stand, and a drive channel, arranged at the front of the staple passage, for receiving the formed staple pushed by the pusher and a driver plate for driving the formed staple in a direction orthogonal to the staple passage.

The inner cartridge that holds the staple sheets may be replaced with an inner cartridge that holds a rolled sheet, the rolled sheet being formed by stacking straight staples together in rolled form.

According to the above construction, the inner cartridge having a plurality of staple sheets is accommodated in the accommodating section of the outer cartridge, and the staple sheets within the inner cartridge are fed to the staple receiving stand via the staple passage for forming. Then, the formed staple is sent to the drive section by the pusher and driven out from the drive section.

The cartridge comprises the inner cartridge and the outer cartridge. Since what is scrapped in the inner cartridge is only the members for holding the staple sheets, disposal of the cartridge of the invention imposes few of the environmental problems normally associated with disposal of synthetic resins.

The outer cartridge is unitized so that the outer cartridge is releasable from the electric stapler main body. For the removal of jammed staples and replacement of staple sheets, the only operation required is to take the outer cartridge out. Therefore, an extremely simple operation is ensured.

If a rolled sheet is used as the inner cartridge, no particular member is required to hold a staple sheet in rolled form, which means that there is no scrap. Therefore, this design is particularly beneficial.

DETAILED DESCRIPTION OF THE PREFERRED EMBODIMENTS

Figure 1:
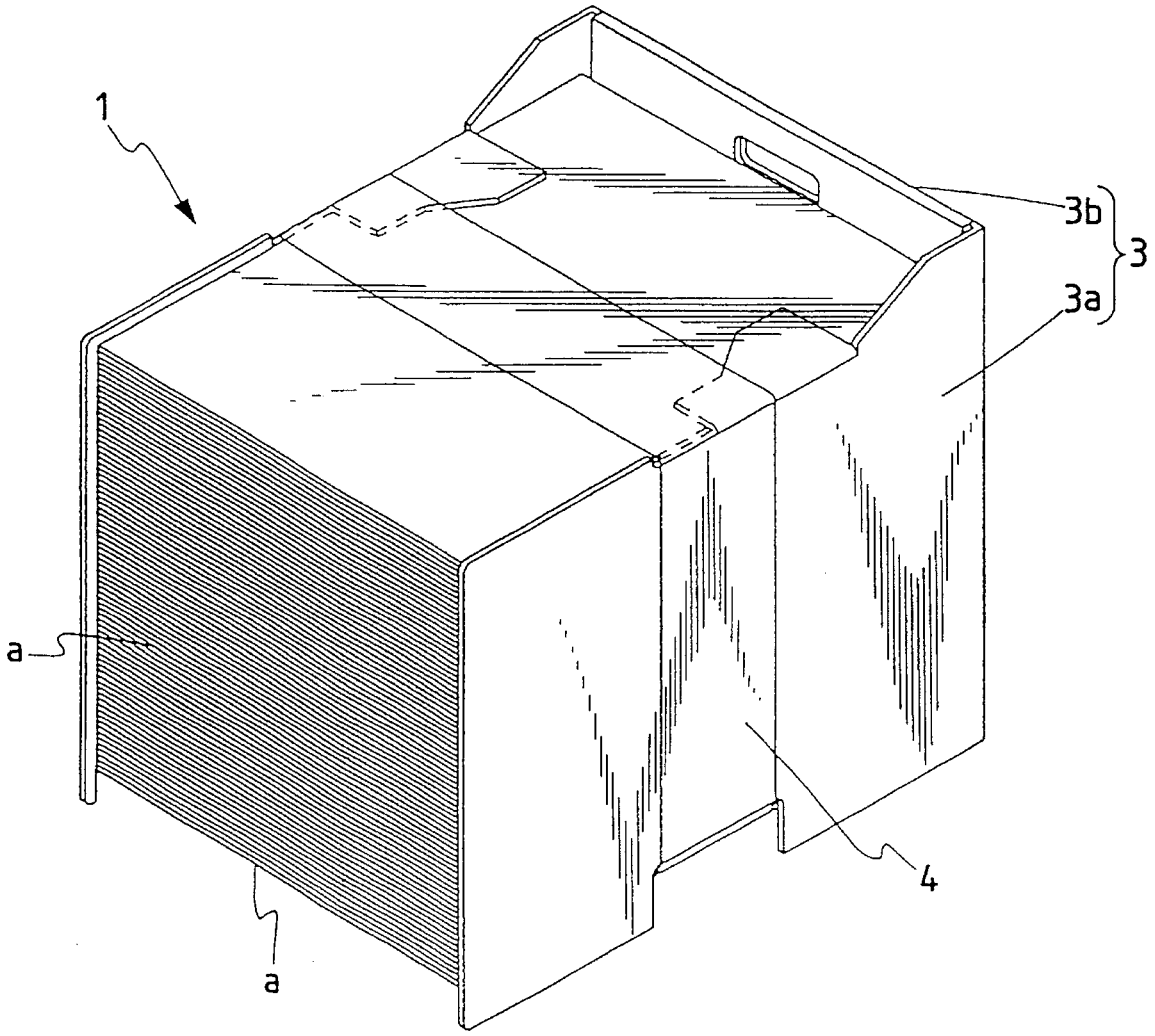
FIG. 1 is a perspective view of an inner cartridge.
Figure 2A:
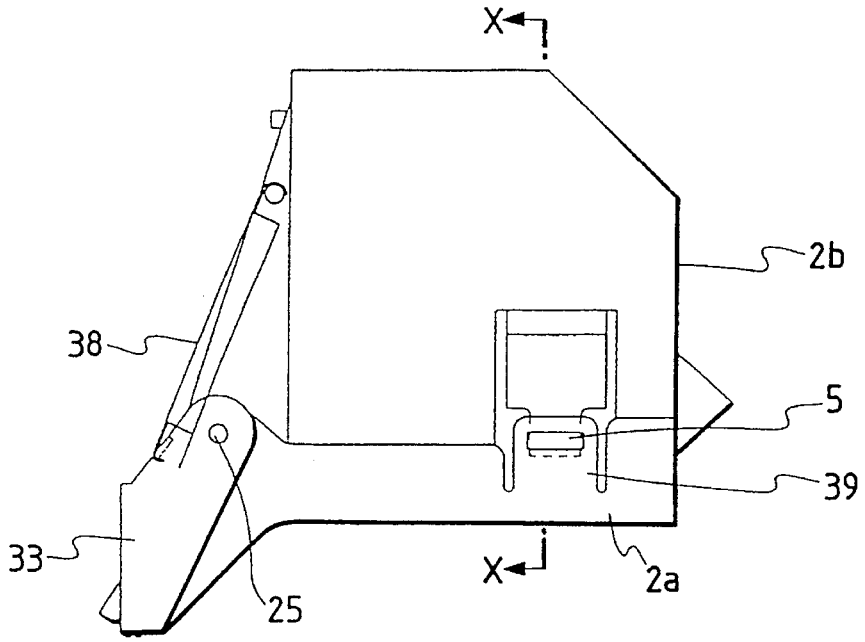
FIGS. 2(*a*) and 2(*b*) are a side view of a cartridge of the invention and a front view of a part thereof in section, respectively.
Figure 2B:
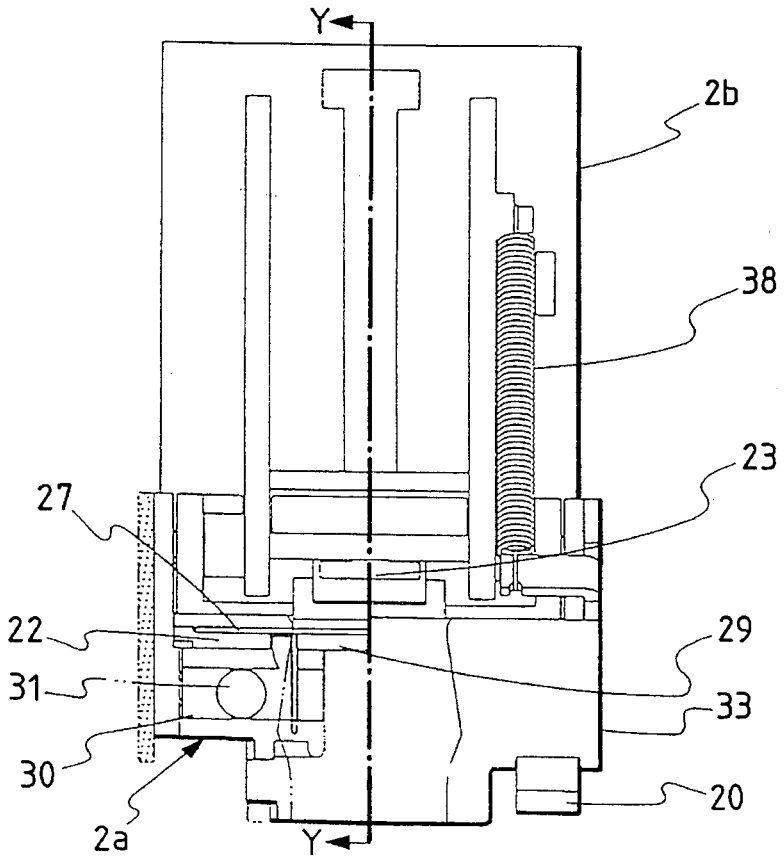
Figure 5:
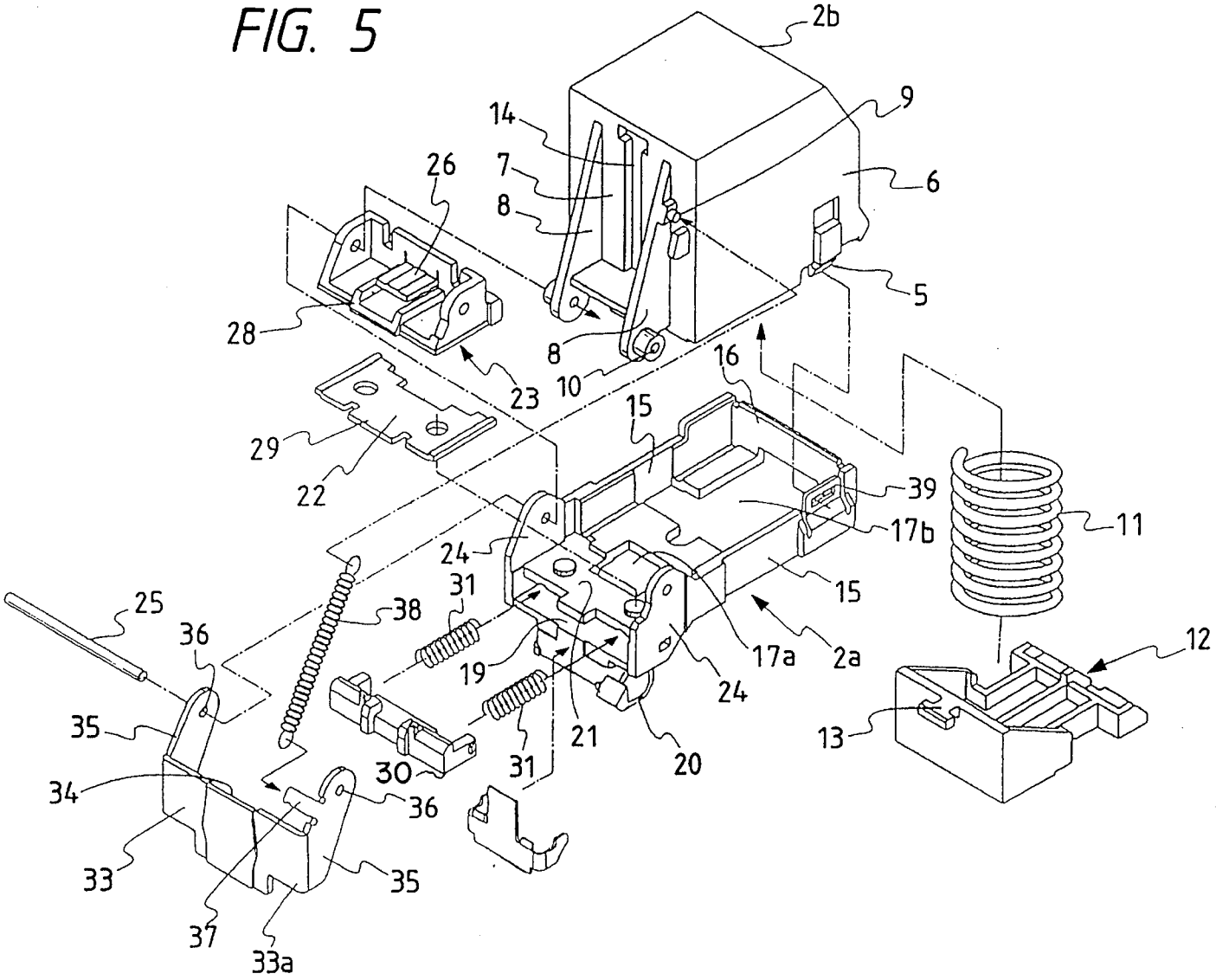
FIG. 5 is an exploded perspective view of an outer cartridge.

A cartridge for an electric stapler according to the invention includes an inner cartridge 1 shown in FIG. 1 and an outer cartridge 2 shown in FIGS. 2(*a*), 2(*b*) to FIG. 5.

The inner cartridge 1 includes: a square U-shaped case 3 formed of a cardboard and a binding band 4 made of paper. The case 3 has both side pieces 3*a* and the rear piece 3*b* formed into a square U-shape and holds a plurality of staple sheets "a" from both left and right sides thereof as well as from the rear side thereof. The plurality of staple sheets "a", each being formed by sticking straight staples together in sheet-like form, are arranged in multi-layered form. The binding band 4 wraps the staple sheets "a" from outside the case 3. Both the case 3 and the binding band 4 may be made of synthetic resin. The construction of the inner cartridge 1 is preferably as simple as possible. An inner cartridge with the staple sheets "a" arranged in multi-layered form and held together only by the binding band may also be used.

The outer cartridge 2 has such a structure as not only to accommodate the inner cartridge 1, but also to perform the functions of sequentially feeding staple sheets to a predetermined position from the bottommost staple sheet a, forming a staple in the front end of the staple sheet into a square U-shape, and driving the thus formed staple out. The outer cartridge 2 includes: a cartridge main body 2*a* and an accommodating body 2*b* for accommodating the inner cartridge 1, the accommodating body 2*b* can be opened and closed with respect to the cartridge main body 2*a*.

Figure 3:
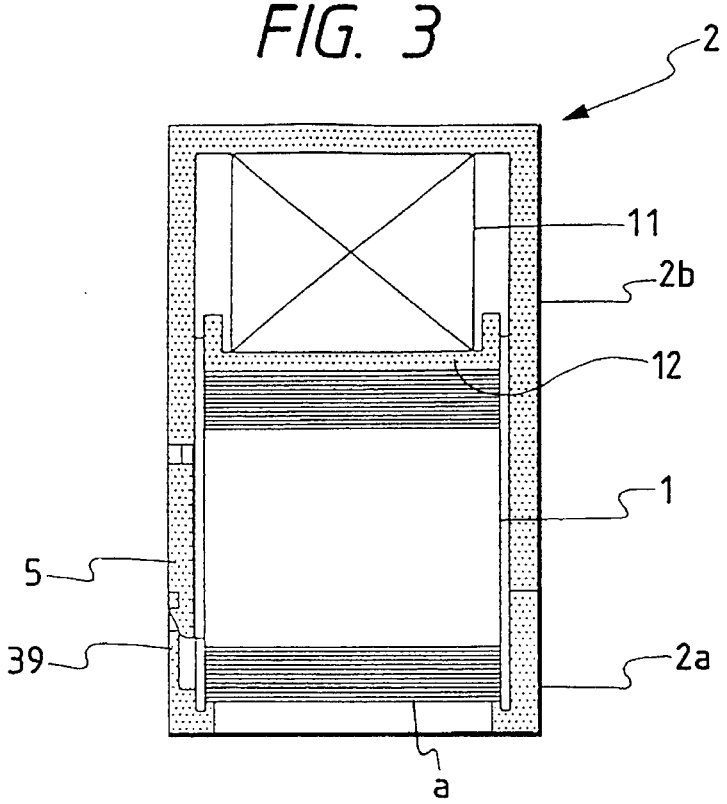
FIG. 3 is a sectional view taken along a line X—X of FIG. 2(*a*)

The accommodating body 2*b* has a space for accommodating most of the staple sheet case 3. The top of the accommodating body 2*b* is closed and the bottom thereof is open. On both side walls 6 of the accommodating body 2*b* are retaining pawls 5, and on a front wall 7 thereof are a pair of triangular projecting walls 8. On top of one of the triangular projecting walls 8 is a spring engaging shaft 9, and on both outer sides of the bottom thereof are bearing sections 10. Inside the accommodating body 2*b* are a pressing spring 11 and a spring holder 12. As shown in FIG. 3, the spring holder 12 fits between the walls of the inner cartridge 1, and abuts against the top of the stack of stapled sheets therein. The pressing spring 11 not only presses the staple sheets "a" within the cartridge 1, but also holds the cartridge 1 downward. On the front of the holder 12 is an engaging projection 13, which is slidable up and down along a long groove 14 formed in the middle of the front wall of the accommodating body 2*b*.

On the other hand, the cartridge main body 2*a* is formed into such a frame that the front and top thereof are open with only both side walls 15 and the rear wall 16. And the bottom thereof has openings 17*a*, 17*b*. The rear half of the cartridge main body 2*a* is formed so as to receive the bottom of the accommodating body 2*b*. A pusher accommodating section 19 that is open frontward is formed at the lower stage of the bottom surface in the front of the cartridge main body 2*a*. Engaging pieces 39 are formed on the rear of side walls, and an L-shaped engaging piece 20 is formed in the lower front.

On the upper surface 21 in the front of the cartridge main body 2*a* are a staple guide 22 and a guide hold 23, which are arranged so as to overlap one upon another. The guide hold 23 is secured by a shaft member 25 that passes through standing portions 24 on both sides in the front of the cartridge main body 2*a*. The shaft member 25 is engaged with the upper surface of a spring piece 26 formed on the upper portion of the guide hold 23.

Figure 4:
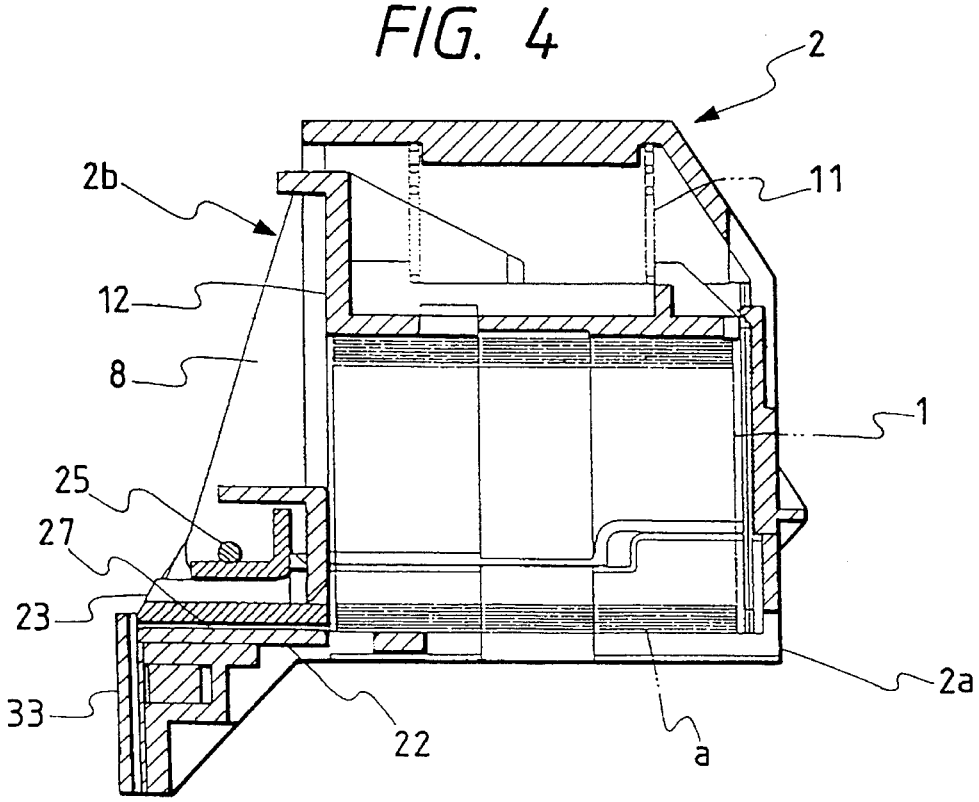
FIG. 4 is a sectional view taken along a line Y—Y of FIG. 2(*b*)

Between the staple guide 22 and the guide hold 23 is a staple passage 27 (see FIG. 4). The staple passage 27 is open both frontward and backward. In the middle of the front of the guide hold 23 is a guide slope 28. Below such guide slope 28 projects frontward a staple receiving stand 29 (also called "anvil") that is formed in the middle of the front end of the staple guide 22. The top surface of the bottom of the cartridge main body 2*a* is flush with the top of the staple guide 22 that constitutes the staple passage 27.

As shown in FIG. 5, within; the pusher accommodating section 19 of the cartridge main body 2*a* is a pusher 30. The pusher 30 sets upon the lower surface of the accommodating section 19 and is slidable thereon. The pusher 30 is retained within the accommodating section 19 by the face plate 33 and is; accommodated therein so as to be slidable forward and backward, and is urged by springs 31 frontward.

Then, a face plate 33 is disposed in front of the staple passage 27 and the pusher 30. On the back of the face plate 33 is a recessed drive channel 34 which effects a passage for driving out a formed staple, which will be described later. The drive channel 34 extends vertically. A lower portion 33*a* is arranged on one side of the face plate 33 so that the L-shaped engaging piece 20 of the cartridge main body 2*a* can be engaged therewith. From both sides of the face plate 33 project side pieces 35 rearward. The face plate 33 is pivotably attached to the cartridge main body 2*a* by causing the shaft member 25 to pass through shaft holes 36 of the side pieces 35. With the face plate 33 attached to the cartridge main body 2*a*, the drive channel 34 faces the front of the staple passage 27.

The cartridge main body 2*a* is coupled to the inner cartridge accommodating body 2*b* so as to be pivotable about the shaft member 25. That is, the shaft member 25 passes through the standing portions 24 on both sides in the front of the cartridge main body 2*a* and the bearing sections 10 of the projecting walls 8 in the front of the accommodating body 2*b*. A tension spring 38 is engaged with both the spring engaging shaft 9 on the projecting wall 8 of the accommodating body 2*b* and an engaging projection 37 formed on the side piece 35 of the face plate 33.

As described above, the outer cartridge 2 is formed by coupling the cartridge main body 2*a* to the inner cartridge accommodating body 2*b*, and can be opened and closed by turning the cartridge main body 2*a* relative to the accommodating body 2*b* about the shaft member 25. To close the outer cartridge 2, the retaining pawls 5 in the rear of the side walls of the accommodating body 2*b* are engaged with the engaging pieces 39 in the rear of the side walls of the cartridge main body 2*a*, as shown in FIGS. 2(*a*) and 3. Accordingly, the accommodating body 2*b* and the cartridge main body 2*a* are integrated with each other and form an accommodating section for accommodating the entire part of the inner cartridge 1 in the inside thereof. To open the outer cartridge 2, the retaining pawls 5 may be pushed inward to release the engagement thereof with the engaging pieces 39.

Figure 6:
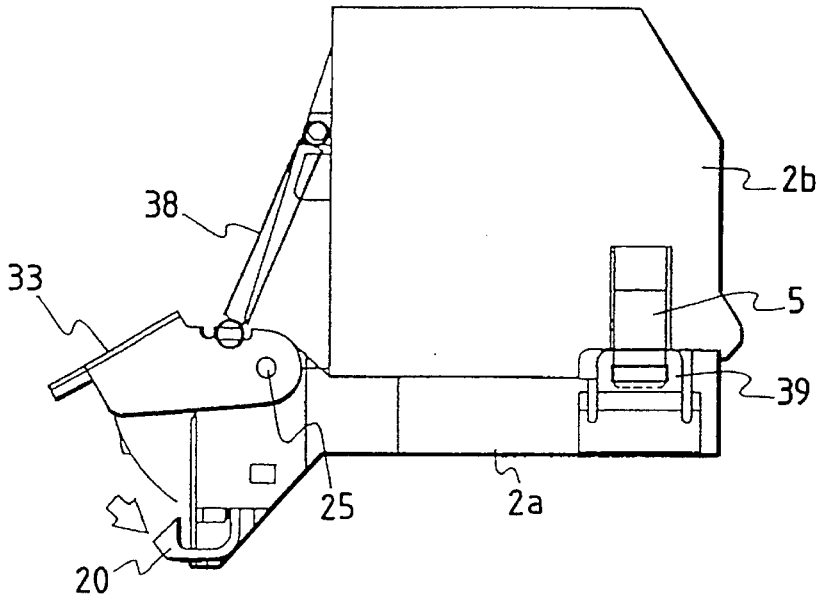
FIG. 6 is a diagram for explaining how the inner cartridge is replaced.

As shown in FIG. 6, to replace the inner cartridge 1, the square U-shaped case 3 of the inner cartridge 1 is removed from the accommodating body 2*b* after the outer cartridge 2 has been opened; and after a new inner cartridge 1 is accommodated in the accommodating body 2*b*, the inner cartridge 1 is closed. After the inner cartridge 1 has been accommodated, the cartridge main body 2*a* and the inner cartridge accommodating body 2*b* are closed, and then the binding band 4 is broken and removed.

Figure 7:
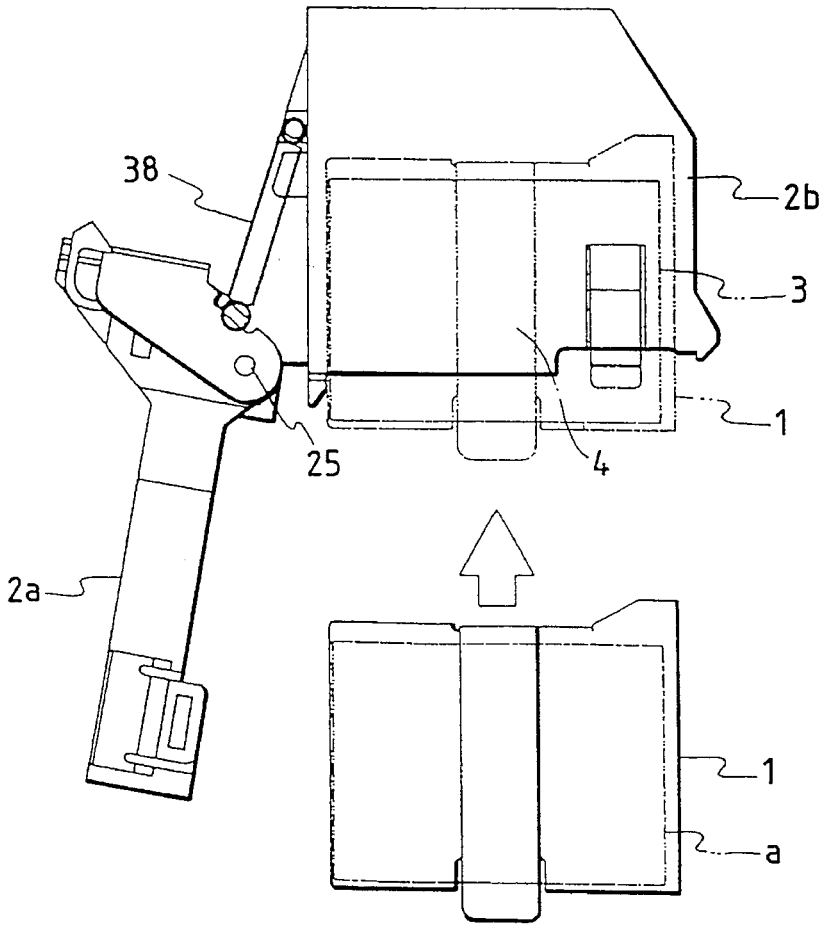
FIG. 7 is a diagram for explaining how a jammed staple is removed.

As shown in FIG. 7, when the L-shaped engaging piece 20 of the cartridge main body 2*a* is released from the face plate 33, the face plate 33 is caused to pivot about the shaft member 25 by the force of the tension spring 38. As a result, the pusher 30 and the staple passage 27 can be exposed.

Figure 8:
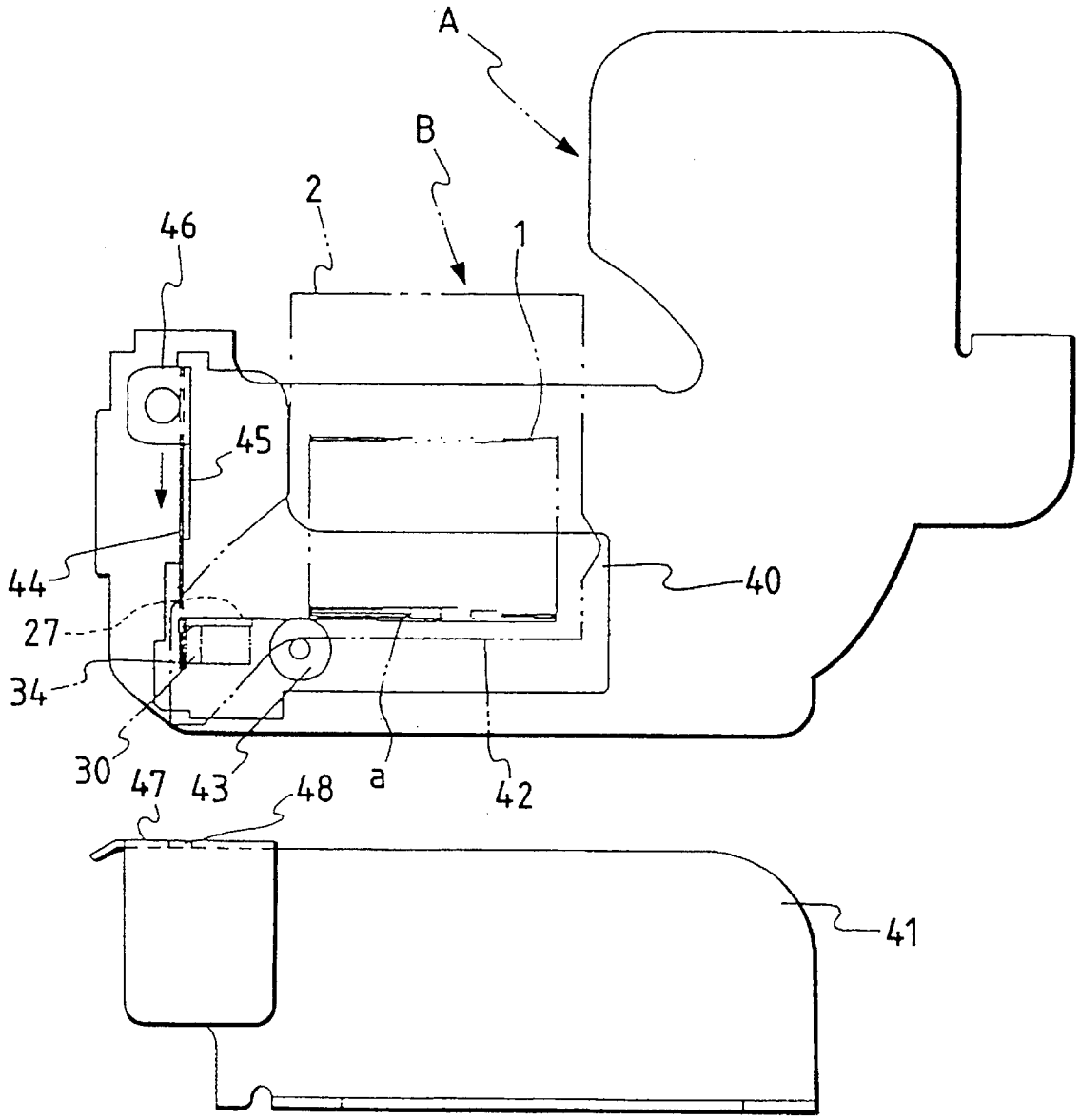
FIG. 8 is a diagram for explaining the cartridge being attached to the electric stapler main body.

Then, as shown in FIG. 8, the electric stapler main body A has a magazine section 40 and a base stand 41. The magazine section 40 includes; an attaching section 42 for attaching the outer cartridge 2; a staple feed roller 43 which extends through opening 17*a* in the bottom of main body 2*a* and into contacting engagement with the bottommost staple sheet, for feeding the staple sheets "a" from within the cartridge 1 forward; a holder 46 that holds both a driver plate 44 and a forming plate 45 (whose lower end is formed into a recess that faces down) so as to overlap one upon another. The driver plate 44 and the forming plate 45 serve to form a square U-shaped staple from the front end of the fed staple sheet "a" and drive the formed staple out, and are connected to not shown drive mechanisms, respectively. On the top in the front of the base stand 41 are a stapling stand 47 and a clincher section 48 for clinching the legs of a staple. The staple feeder comprising the feed roller 43 and the drive mechanism thereof as well as the forming and driving device formed of the driver plate 44, the forming plate 45, and the drive mechanisms thereof may be known means and, therefore, they are not limited to those mentioned above.

By the way, when the cartridge is attached to the attaching section of the electric stapler main body, the staple feed roller 43 enters slightly into the staple sheet accommodating section from the opening (17*a*) of the cartridge B, so that the staple feed roller 43 is engaged with the lower surface of the bottommost staple sheet "a" in the inner cartridge 1. At the same time, the driver plate 44 and the forming plate 45 are disposed above the drive channel 34 on the back of the face plate (33) and the staple receiving stand (29) on the front end of the staple passage 27, respectively.

The operation of the thus constructed electric stapler will now be outlined with reference to FIG. 8. When the staple sheet roller 43 is driven by operating a mechanism for driving a staple sheet "a" feeder, the bottommost staple sheet "a" within the accommodating section is discharged by the frictional resistance thereof with the staple feed roller 43 from the accommodating section, so that the staple on the front end of the staple sheet "a" is abutted against the back of the face plate (33) (excluding the drive channel 34) along the staple passage 27, and fed forwardly to a position above the staple receiving stand (29). Then, by operating a mechanism for driving the forming and driving device, the driver plate 44 and the forming plate 45 are driven downward. The driving device initially makes a blank drive because no staple is supplied at the drive channel 34 of the face plate 33. Since the staple on the front end of the staple sheet "a" has been supplied below the forming plate 45, the forming plate 45 starts forming the staple into a square U-shape by clinching both sides of the staple protruding from the staple receiving stand (29) downward thus forming the legs of a staple. The legs of the staple are pushed downward by the forming plate 45 and contact the top beveled portion at, the front of the pusher 30 to cause the pusher 30 to move backward against the force of the springs 31. However, since the width of the formed staple becomes substantially equal to the width of the drive channel 34 of the face plate 33, the formed staple is guided to the drive channel 34 by the pusher 30 through the upward movement of the driver plate 44. When the driving mechanism is activated, the driver plate 44 drives out the formed staple positioned at the drive channel 34 downward and, simultaneously therewith, the forming plate 45 forms the next staple into a square U-shape. The legs of the driven-out staple pierce a material to be stapled, and are clinched by the clincher section 48 to complete the stapling operation. The staple sheet "a" is sequentially formed and driven out by repeating the above operation. Since the above operation is the same as that disclosed in Japanese Unexamined Utility Model Publication No. 4-54683 and the like, no detailed description thereof will be herein given.

When a staple is jammed by buckling or the like during the stapling operation, the jammed staple can be removed by taking the outer cartridge 2 out of the electric stapler main body A and following the procedure indicated in FIG. 7. The inner cartridge 1 may be replaced by taking the outer cartridge 2 out of the electric stapler main body A and following the procedure indicated in FIG. 6.

According to the above construction, the cartridge releasably attached to the electric stapler main body includes the inner cartridge 1 and the outer cartridge 2. What is to be scrapped in the inner cartridge 1 are only the square U-shaped case 3 and the binding band 4. Therefore, handling of the cartridge is easy and imposes few environmental problem.

The outer cartridge 2 is unitized so that the outer cartridge is releasable from the electric stapler main body. For the removal of jammed staples and replacement of staple sheets "a", the only operation required is to take the outer cartridge 2 out. Therefore, an extremely simple operation is ensured.

The sheet feed roller 43 may be incorporated into the outer cartridge 2.

Figure 9:
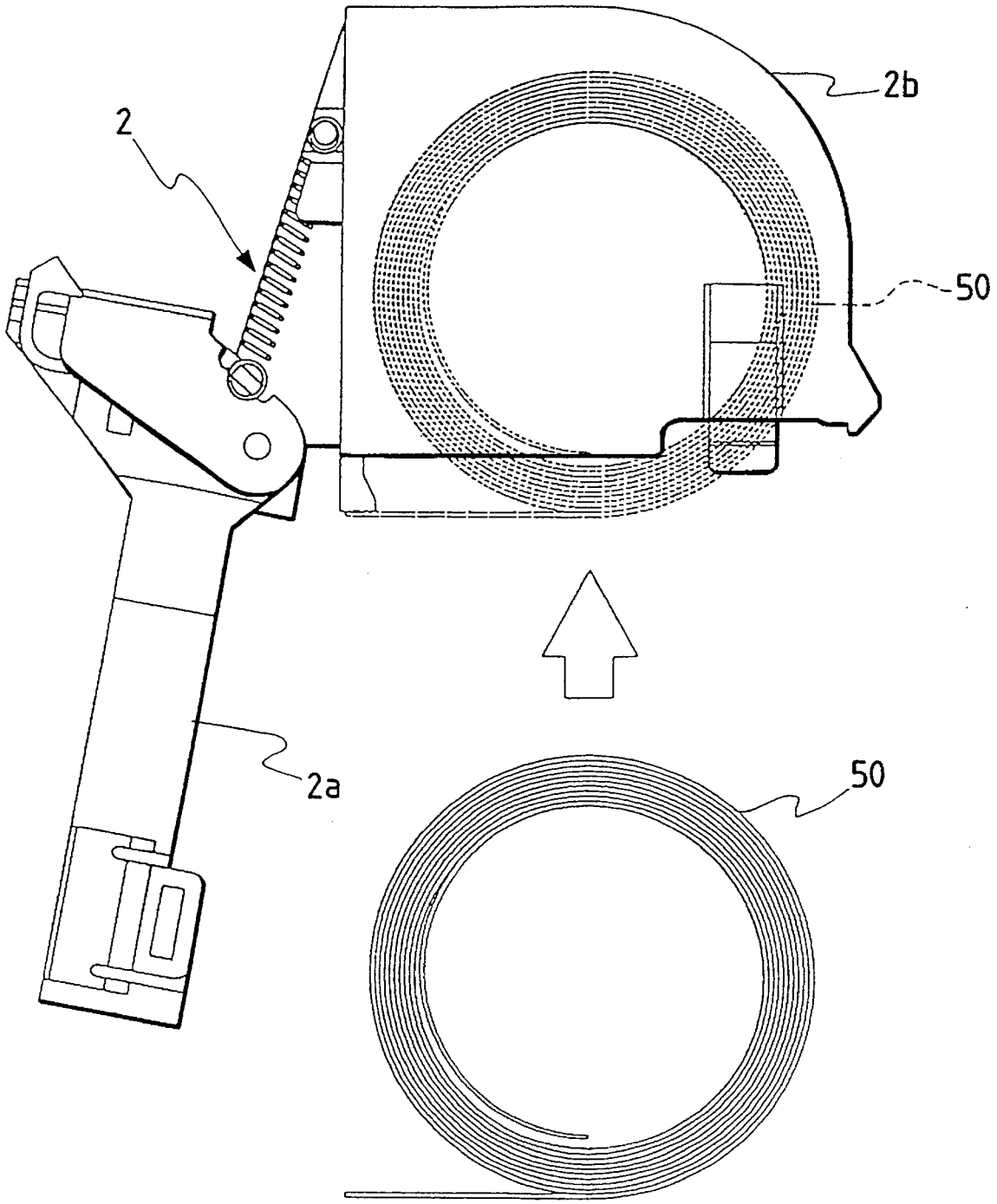
FIG. 9 is a diagram for explaining another exemplary inner cartridge.

The inner cartridge is not limited to the one designed to hold the staple sheets. For example, as shown in FIG. 9, a rolled sheet 50 that is formed by sticking straight staples together in rolled form may be used as the inner cartridge. In the rolled sheet a member such as the binding band can be dispensed with. Therefore, the rolled sheet itself can be used as the inner cartridge. In this case, a member for holding the staple sheet in rolled form is not particularly necessary. This means that nothing is scrapped in the case of the rolled sheet. Hence, the inner cartridge formed by the staples in rolled form is extremely beneficial.

What is claimed is:

1. A cartridge for an electric stapler comprising:

an inner cartridge for holding a plurality of staple sheets in multi-layered form, each of the stapler sheets being formed by sticking straight staples together in sheet-like form; and an outer cartridge associated with said inner cartridge and detachably mounted on the electric stapler, said outer cartridge including, a main body, an accommodating body releasably attached to said main body for accommodating said inner cartridge, a staple passage formed so as to extend from a lower end of said accommodating body, a staple receiving stand disposed at a front end of said staple passage, a pusher for pushing legs of a staple forward, said staple being formed into a square U-shape on said staple receiving stand, and a drive channel, arranged at the front of said staple passage, for receiving the formed staple pushed by said pusher, wherein a driver plate of the electric stapler drives the formed staple in a direction orthogonal to said staple passage.

2. A cartridge for an electric stapler according to claim 1, wherein said inner cartridge is made of a paper.

3. A cartridge for an electric stapler according to claim 1, wherein said inner cartridge is made of synthetic resin.

4. A cartridge for an electric stapler comprising:

an inner cartridge for holding a rolled sheet, the rolled sheet being formed by sticking straight staples together in rolled form; and an outer cartridge associated with said inner cartridge and detachably mounted on the electric stapler, said outer cartridge including, a main body, an accommodating body releasably attached to said main body for accommodating said inner cartridge, a staple passage formed so as to extend from a lower end of said accommodating body, a staple receiving stand disposed at a front end of said staple passage, a pusher for pushing legs of a staple forward, said staple being formed into a square U-shape on said staple receiving stand, and a drive channel, arranged at the front of said staple passage, for receiving the formed staple pushed by said pusher, wherein a driver plate of the electric stapler drives the formed staple in a direction orthogonal to said staple passage.

5. A cartridge for an electric stapler according to claim 4, wherein said inner cartridge is made of a paper.

6. A cartridge for an electric stapler according to claim 4, wherein said inner cartridge is made of synthetic resin.

* * * * *